United States Patent [19]

Schwarz

[11] 3,960,182

[45] June 1, 1976

[54] HEDDLES FOR WEAVING MACHINES HAVING HEDDLE FRAME BARS FOR SEVERAL HEDDLES, WHICH BARS ARE MOVED BY A SHED-FORMING DEVICE

[75] Inventor: Rudolf Schwarz, Horgen-Zurich, Switzerland

[73] Assignee: Staeubli, Ltd., Horgen-Zurich, Switzerland

[22] Filed: Apr. 7, 1975

[21] Appl. No.: 565,395

[30] Foreign Application Priority Data

Apr. 9, 1974 Switzerland.....4975/74

[52] U.S. Cl...... 139/91; 139/93; 139/94; 139/96

[51] Int. Cl.[2]..... D03C 9/00; D03C 9/02

[58] Field of Search..... 139/93–96, 139/368, 82, 85, 90, 91, 92

[56] References Cited

UNITED STATES PATENTS

| | | | |
|---|---|---|---|
| 779,193 | 1/1905 | Wagner | 139/93 |
| 795,368 | 7/1905 | Renkel | 139/91 |
| 1,309,674 | 7/1919 | Wilson | 139/93 |
| 1,847,579 | 3/1932 | Turner | 139/93 |
| 2,209,597 | 7/1940 | Clark et al. | 139/93 X |
| 3,776,280 | 12/1973 | Kliot | 139/33 |

FOREIGN PATENTS OR APPLICATIONS

| | | | |
|---|---|---|---|
| 62,079 | 2/1864 | France | 139/94 |
| 76,550 | 5/1967 | France | 139/96 |
| 608,180 | 1/1935 | Germany | 139/91 |

*Primary Examiner*—James Kee Chi

*Attorney, Agent, or Firm*—Woodhams, Blanchard and Flynn

[57] ABSTRACT

Several heddles consist of a continuous cord, which is wound looplike around the bars of the heddle frame. The heddles have a thread guide in nonelastic section and an elastic section.

11 Claims, 29 Drawing Figures

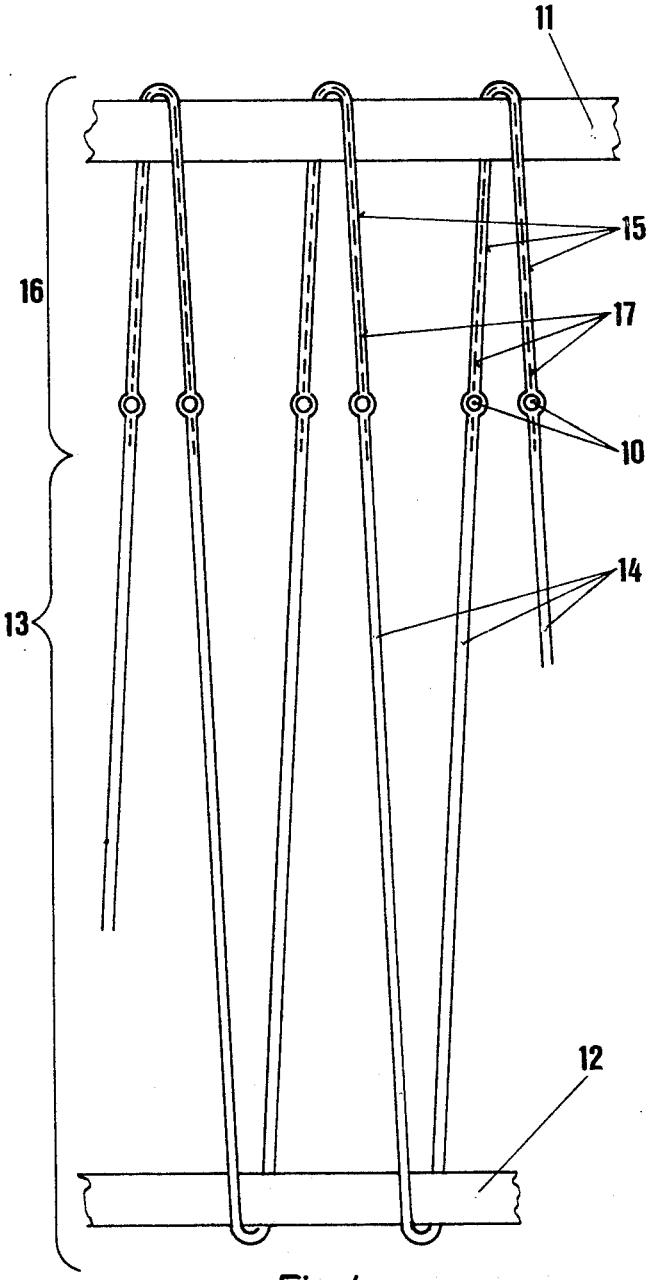
Fig.4
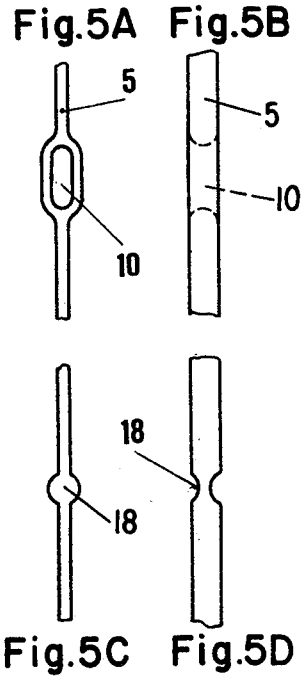

HEDDLES FOR WEAVING MACHINES HAVING HEDDLE FRAME BARS FOR SEVERAL HEDDLES, WHICH BARS ARE MOVED BY A SHED-FORMING DEVICE

FIELD OF THE INVENTION

The invention relates to weaving heddles for weaving machines having heddle frame bars for several heddles, which bars are moved by a shed-forming device or dobby.

BACKGROUND OF THE INVENTION

The heddles in weaving machines have the purpose of lifting and lowering the warp threads which are guided through a thread guide in order to form the weaving shed. The heddle must thereby in its longitudinal expansion direction only produce a small force of some grams. The known heddles of today consist of metal. Prior to the time when heddles were made of metal, same consisted of threads and ropes having thread guides attached to or tied therein. The friction between such heddles and the warp threads was unfavorable, and the heddles had to be manufactured manually with much work and had to be tied into the heddle frame.

When the rotational speeds increased in modern weaving machines, it has been proven that the shed-forming machine must, aside from the force for moving the warp threads from the lower shed to the upper shed and vice versa, apply at times a still greater force in order to accelerate and to delay the mass of the heddles which are secured on a heddle bar. Since such forces increase in the square with respect to the rotational speed increase, it became necessary to reinforce spring draw registers and shed-forming machines. This results in turn in heavy moved parts. The mass accelerative forces thus increase until an increase of the rotational speed no longer brings about any economical advantage. Also the situation occurs that the heddles are prematurely destroyed due to the accelerative forces which act onto said heddles.

The purpose now is to achieve a weight reduction in heddles and frames, which permits a further increase in the operating speed of weaving machines.

This is attained by weaving heddles for weaving machines which are secured at least on one side to a heddle frame bar movable by a shed-forming machine or dobby and which have a thread guide thereon for warp threads and on the other side are held in approximately parallel direction with respect to one another and perpendicularly with respect to the warp threads. The heddles are characterized inventively by two and more weaving heddles consisting of one single cord of a flexible, practically nonelastic, nonmetallic material, which is looped over and around known end-securing bars on the individual heddles directly or by interpositioning an elastic band.

The use of a nonmetallic cord for the manufacture of heddles, for example rigid plastic, results in a noticeable reduction of the entire weight of the heddles. The plastic can be die-cast or extruded.

BRIEF DESCRIPTION OF THE DRAWINGS

Various examplary embodiments of the subject matter of the invention are illustrated in the drawings, in which:

FIG. 4 is a view of a modified embodiment, in which the heddle cord and the elastic rope are integrally connected together, FIGS. 5A and 5B are two views of a section of a heddle band prior to its installation in a frame.

DETAILED DESCRIPTION

Figure 1:
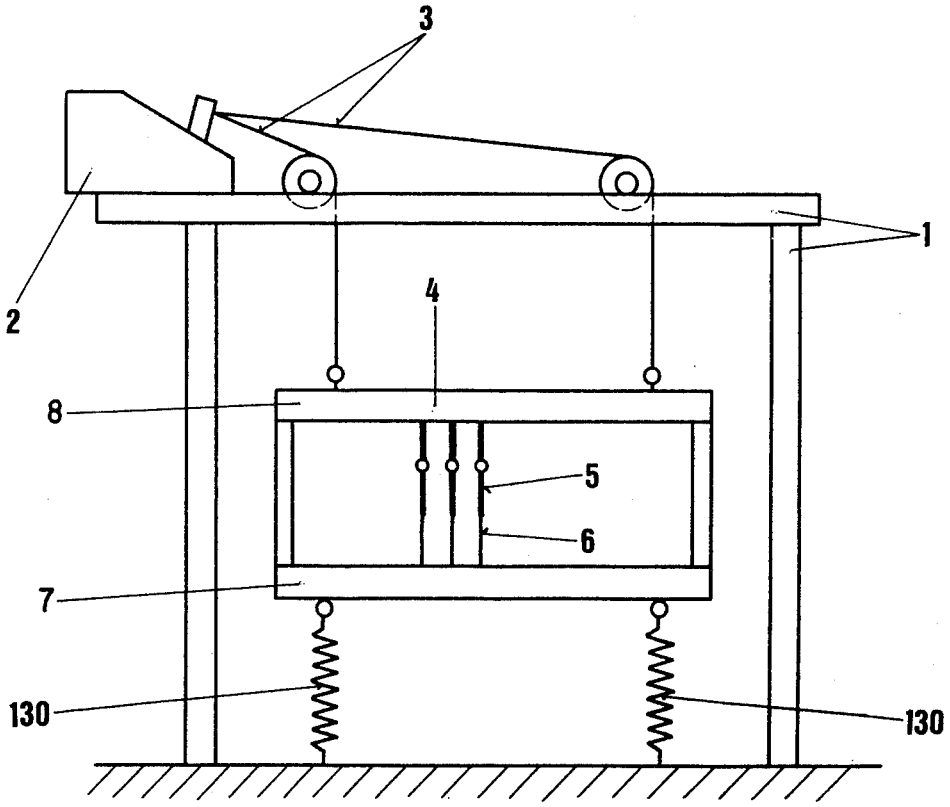
FIG. 1 is a schematic view of a weaving maching having a spring release.

A shed-forming device or dobby 2 is positioned on a machine frame 1, which dobby moves the frame 4 up and down through draw members 3. The release or return springs are identified with reference numeral 130.

Figure 2:
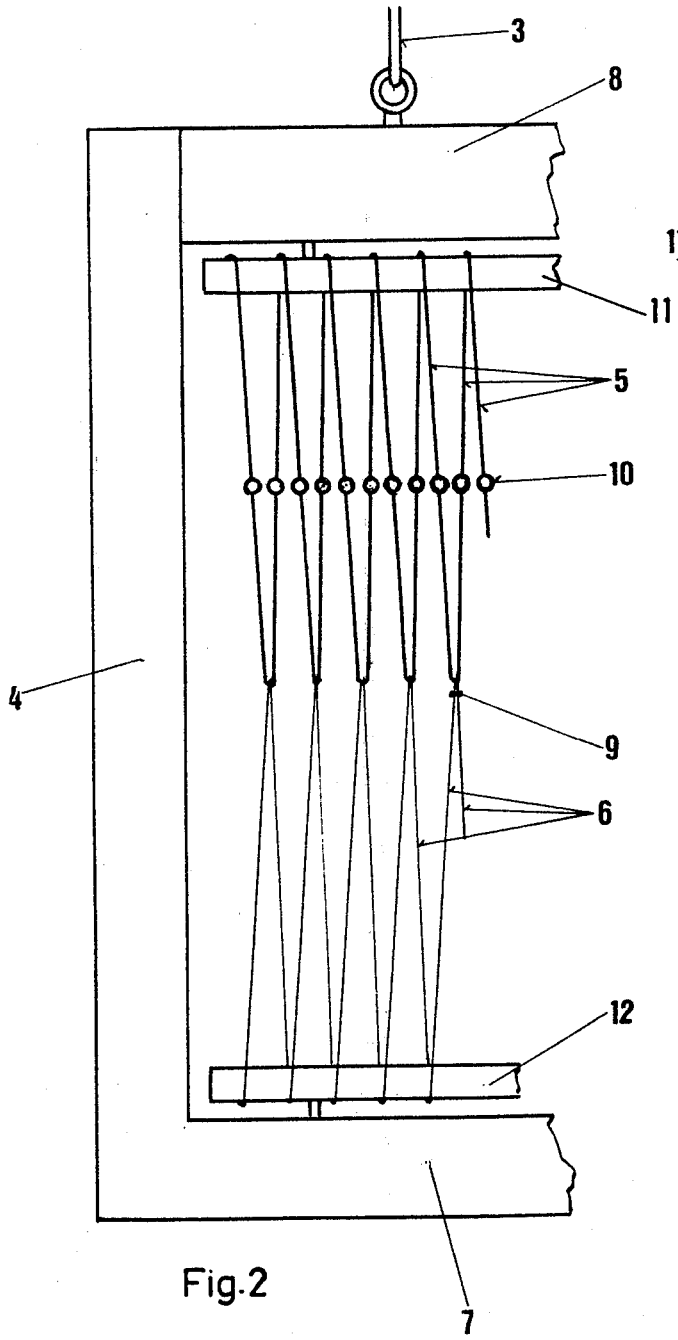
FIG. 2 is an enlarged partial view of a frame having inventive heddles.
Figure 3:
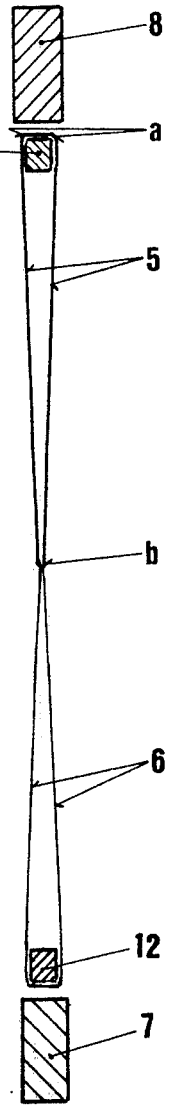
FIG. 3 is a cross-sectional view of FIG. 2.

FIGS. 2 and 3 illustrate the left half of a frame which comprises an upper and a lower horizontal frame bar 8 and 7, respectively. The heddles 5 are held in the frame by means of the bands 6. The heddles 5 are made of a continuous cord of flexible, practically nonelastic, nonmetallic material, which cord is looped over and around the upper threading-on rod 11 secured to the upper frame bar 8. The lower end loops of the heddles 5 are engaged by the continuous, elastic band 6, which is looped over and around the lower threading-on rod 12 secured to the lower frame bar 7.

The thread guides or eyelets are identified by reference numeral 10 and all lie in the same plane. To accomplish the aforementioned coplanar relationship, the cord has adjacent the upper bending point *a* and the lower bending point *b* a permanent deformation achieved by a thermal process. The permanent deformations permits the placement of the heddle windings on the rods 8 and the alignment of the thread guides 10 at an equal level. In addition, the permanent deformations permit the heddle band or cord to snuggly engage the rod 11 and the elastic band 6 without any space therebetween.

The winding loops of the heddles and of the bands on the rods can, if desired, be secured against slipping by U-shaped clamps.

At point *b*, as is shown by reference numeral 9 in FIG. 2, the band 6 may have two knots or thickened portions, which prevent a movement of the band 6 in the lower loop of the heddle cord 5. The heddle cord 5 may also have such knots. Such knots or thickened portions can, if desired, be placed in a groove or slot of a threading-on rod 11 and 12. These rods 11 and 12 can, if desired, also have a U-shaped cross-sectional shape so that the U-legs can be bent to the inside of the U and the knots or thickened portions on the bands are received between the bent-in legs.

In the embodiment according to FIG. 4, the heddle cord and the band are united into one single band which is strung onto the threading-on rods 11, 12 of a frame. This band consists, on the lower part 13, of an elastic part 14 and, on the upper part 16, of a nonelastic part 15 which forms the heddle. The part 15 has the thread guide or eyelet 10 therein. For example, the band consists of one single basic substance, like rubber, polyurethane, to which is admixed in the heddle part 15 a fiber material having a small elastic expansion, like glass fibers 17. Thus the band is composed interchangeably of an elastic section 14 and a nonelastic section 15.

A further embodiment comprises the making of the entire band 14, 15 of an elastomer, the heddle section 15 of which is treated with or without any initial tension with a lacquer coating or something similar, so that this section has in relationship to a different section 14 during the start of an application of tension thereto, only an unimportant elastic expansion. The same objective is also attained by reinforcing the heddle band, which is, to begin with, completely elastic in the section 16, by stretching it so that one obtains an inelastic section 15 and the remaining section 14 remains elastic.

FIGS. 5A and 5B illustrate two section view of a section of a heddle band 5 having the thread guide 10 therein as is used in the embodiment according to FIG. 2. FIGS. 5C and 5D show two section view of the predetermined bending point 18 which is flattened to define a wide part which makes the 180° bending thereof easier at this location.

Figure 6A:
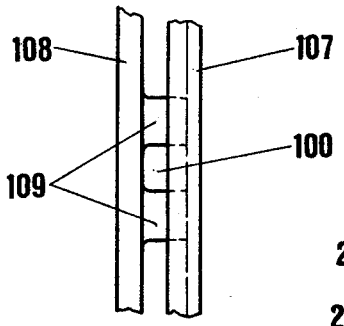
FIGS. 6A to 14C are each two to three views of modified embodiments of heddles and thread guides.
Figure 6B:
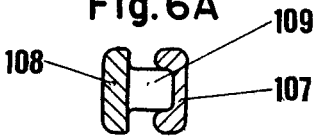

FIGS. 6A and 6B illustrate a side view and a cross-sectional view of a different embodiment for a heddle cord. The heddle cord consists of an elongated member 108 having laterally projecting lugs 109 thereon so that each two lugs form the limiting surfaces for the thread guide 100. The lugs are supported on a second elongated member 107 having a U-shaped cross section. The free ends of the lugs are connected to the second member 107 by welding or gluing. Outside of the area of the thread guide, both members are glued together or bonded together.

Figure 7A:
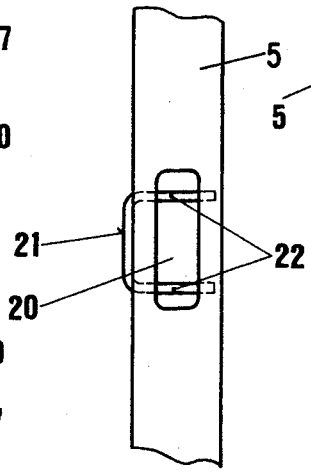
Figure 7B:
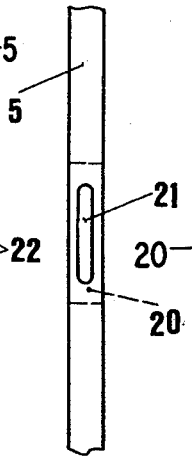
Figure 7C:
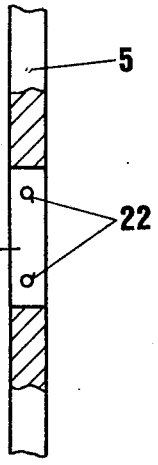

In the case of the thread guide illustrated in FIGS. 7A, 7B and 7C, the upper and the lower support location for the warp thread is formed by the legs 22 of a clasp 21, which is inserted laterally into the heddle cord 6. Thus a strong support for the warp thread is produced on the points of the thread guide, which points are particularly stressed by the warp thread. The legs 22 of the clasp 21 are bent within the opening of the thread guide in such a manner that the warp thread engaged therewith is guided against the longitudinal axis of the eye. In addition, this bending secures the clasp against a falling out. The clasp is made advantageously of metal, for example of chrome-plate or polished steel, or of a plastic which is harder than the material of the heddle cord.

Figure 8A:
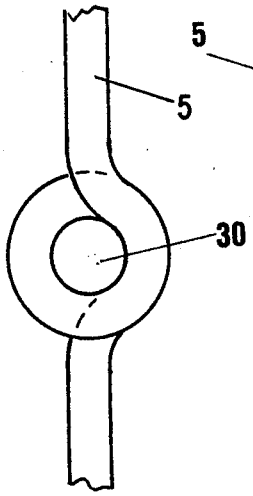
Figure 8B:
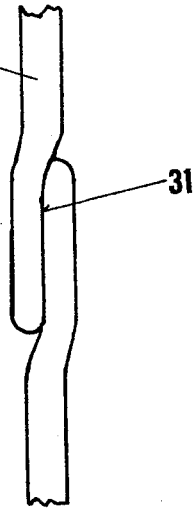

The illustrations of FIGS. 8A and 8B show a thread guide 30 which is formed by a heddle band wound around approximately 540°. The windings are glued together or welded together at the point of contact 31. The shape of the guide can be permanently fixed by a thermal or chemical process or by applying layers thereon.

Figure 9A:
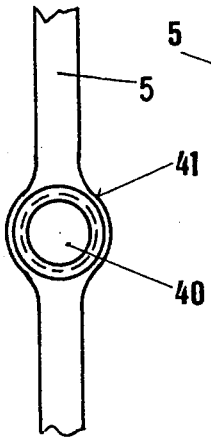
Figure 9B:
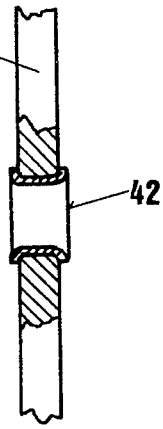

FIGS. 9A and 9B illustrate a thickened portion 41 produced in a heddle cord 5 having a hole therethrough into which is received a cylinderlike eye 42 for forming the thread guide 40. The edges of the eye are rolled over. Thus a smooth and strong guide is produced for the warp thread.

Figure 10A:
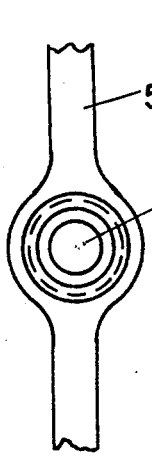
Figure 10B:
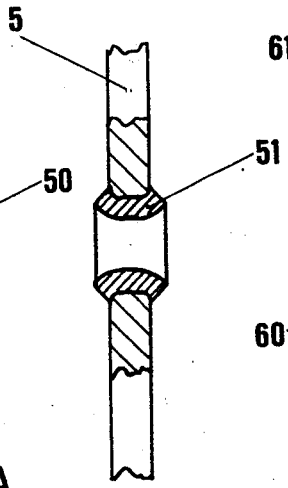

FIGS. 10A and 10B show an eye 51 which is secured in the heddle cord 5 by a snapping in operation to form a thread guide 50.

Figure 11A:
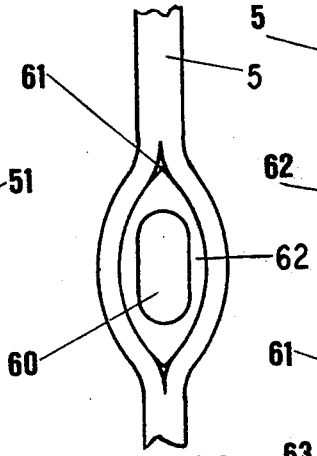
Figure 11B:
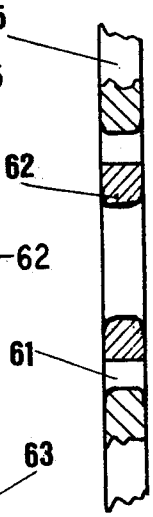
Figure 11C:
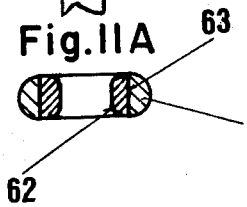

In the thread guide according to the three illustrations of FIGS. 11A, 11B, and 11C, the heddle cord 5 is split in the longitudinal direction to which creates the hole 61. An eye 62, which forms the actual thread guide 60, is gripped therein. The eye is glued to or welded to the wall of the hole 61 at 63.

Figure 12A:
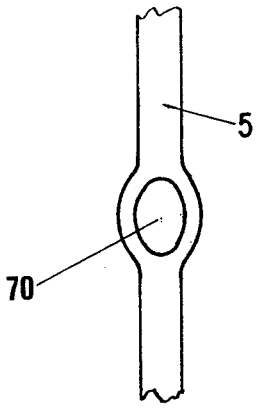
Figure 12B:
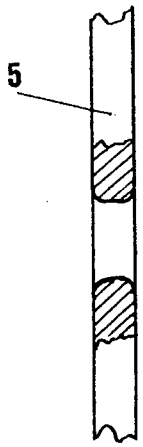

FIGS. 12A and 12B show a heddle cord 5 in which a thread guide 70 was created by punching a hole. With the help of a thermal or chemical finish treatment, the edges of the hole which come into contact with the warp threads are rounded off and smoothened. The same objective is achieved by a lacquer coat, whereby in each case the surface can, at the same time, be hardened against wear by the warp thread. The hardening process is achieved by permeating the heddle cord totally or only on the surface or on the lacquer with wear-resistance material. Such material, which also protects the warp thread, may be a dry lubricant, such as graphite, molybdenumdisulfide, etc., or a material which is wear-resistance to abrasion, such as glass balls, metal powder, etc. For the same purpose, the thread guide or the entire heddle cord can be coated with a metal coating applied by steaming, spraying, plunging or galvanizing.

Figure 13A:
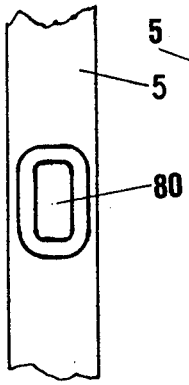
Figure 13B:
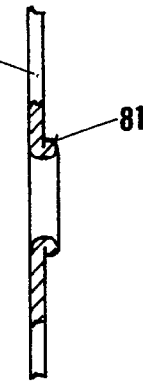

FIGS. 13A and 13B illustrate a flat heddle band 5, in which a thread guide 80 is formed by putting ahole therethrough and turning over the hole edge 81.

Figure 14A:
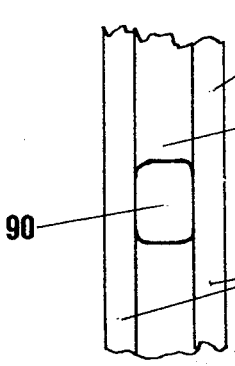
Figure 14B:
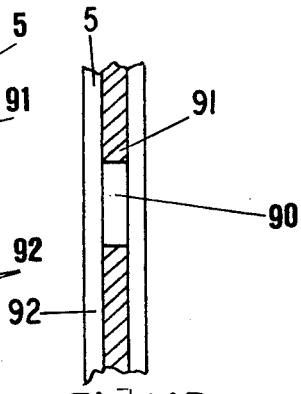
Figure 14C:
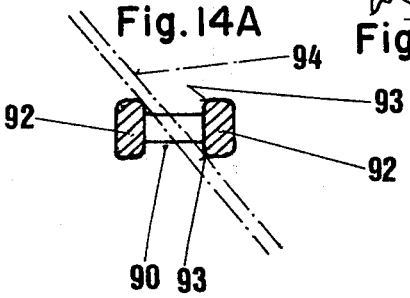

FIGS. 14A, 14B and 14C illustrate a heddle cord 5 having an H-shaped cross section and having an opening in the web 91 thereof to form a thread guide 90. The profile legs 92 have rounded portions 93 and are dimensioned such that a warp thread 94 which lies inclined in the thread guide engages the rounded portions on the web 91 and not on the edge of the opening. The two other walls of the windows can also be bordered by similar but not illustrated webs 92.

The illustrated examples of the heddle cord 5 and the thread guide 10 have not been exhaustively presented herein. The cord must be rigid and have a small elasticity, a large surface slidability in the area of the thread guide and a small weight.

It is also possible to provide in one heddle zone more than one thread guide of differing size and shape, for example, to carry out a function in the warp thread pulling in machines.

As has already been mentioned, it is possible to embed glass threads, carbon fibers, natural fibers or the like in a heddle cord made of plastic or the heddle cord may itself consist of such fibers which are held together by lacquer or glue so that the cord has thread guides bound in, glued on or sprayed on.

The thread guide in the heddle cord can be created by a melting process from a full web, during which process the excessive material flowing away from the opening leaves behind beads in the edge zone of the opening and, as a result, the thread guide receives a rounded-off edge portion which is advantageous for the warp thread. Through a suitable choice of the cord material and of the heating source, the material which is melted away can be changed into a condition which is more favorable for wear, for example by singeing, oxydizing, reducing, alloying.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a weaving machine having a heddle frame composed of at least vertically spaced upper and lower frame members and a plurality of heddle means having eyelets therein extending between said upper and lower frame members, the improvement comprising wherein said heddle means consists of one single cord of flexible, practically nonelastic, nonmetallic material having a plurality of said eyelets formed therein and along the length thereof, said single cord being looped around at least said upper frame member a plurality of times with said eyelets being horizontally aligned and elastic band means secured to said nonelastic, nonmetallic material and engaging said lower frame member for keeping said nonelastic, nonmetallic material taut.

2. The improvement according to claim 1, wherein said elastic band means is looped around said lower frame member a plurality of times, each loop of said elastic band means being intertwined with a loop of said nonelastic, nonmetallic material.

3. The improvement according to claim 1, wherein said elastic band means is integral with said nonelastic, nonmetallic material, said nonelastic, nonmetallic material being alternately connected to said elastic band means, said nonelastic, nonmetallic portion being looped around said upper frame member, said elastic band means being looped around said lower frame member.

4. The improvement according to claim 3, wherein said nonelastic, nonmetallic portion of said cord consists of an elastic material to which a relatively nonelastic fiber material is admixed to make same nonelastic.

5. The improvement according to claim 3, wherein said heddle means of one frame consists of said one single cord.

6. The improvement according to claim 2, wherein said nonelastic, nonmetallic portion of said cord has means for preventing a shifting in a direction parallel to the longitudinal axis thereof at the points of engagement with said upper heddle frame.

7. The improvement according to claim 6, wherein said means consist each of an enlarged portion of said cord located on both sides of said upper heddle frame.

8. The improvement according to claim 2, wherein said nonelastic, nonmetallic portion has weaker bending points therein.

9. The improvement according to claim 2, wherein said elastic band means has enlarged portions on both sides of a loop of said nonelastic, nonmetallic portion.

10. The improvement according to claim 1, wherein said cord consists of plastic reinforced by fibers.

11. The improvement according to claim 1, wherein said cord consists of fibers coupled together.

* * * * *